United States Patent [19]

Beatty et al.

[11] 3,980,494

[45]*Sept. 14, 1976

[54] METHOD OF REDUCING FRICTION IN BLADE CLEANING OF IMAGING SURFACES

[76] Inventors: Charles L. Beatty, 130 Graystone Lane, Brighton, N.Y. 14618; Nero R. Lindblad, R.D. 3, Palmyra, N.Y. 14522; Henry R. Till, 111 Hampshire Drive, Rochester, N.Y. 14618

[ * ] Notice: The portion of the term of this patent subsequent to May 4, 1993, has been disclaimed.

[22] Filed: Oct. 29, 1975

[21] Appl. No.: 626,889

Related U.S. Application Data

[62] Division of Ser. No. 538,041, Jan. 2, 1975, Pat. No. 3,954,466.

[52] U.S. Cl. ..... 134/6; 15/256.5; 15/256.51; 355/15

[51] Int. Cl.[2] ..... B08B 1/02

[58] Field of Search ..... 96/1.5, 1.8; 427/76; 134/6, 7; 355/15; 15/256.5, 256.51, 256.52

[56] References Cited

UNITED STATES PATENTS

| | | | |
|---|---|---|---|
| 3,080,596 | 3/1963 | Symbolik | 15/250.36 |
| 3,234,017 | 2/1966 | Heyl et al. | 96/1 |
| 3,552,850 | 1/1971 | Royka et al. | 355/15 |
| 3,625,688 | 12/1971 | Te Velde | 96/1.5 |
| 3,649,354 | 3/1972 | Te Velde | 427/76 |
| 3,660,863 | 5/1972 | Gerbasi | 15/256.51 |
| 3,728,016 | 4/1973 | Harbour et al. | 355/15 |
| 3,848,993 | 11/1974 | Hasiotis | 355/15 |
| 3,871,881 | 3/1975 | Mikelsons | 96/1.5 |

FOREIGN PATENTS OR APPLICATIONS

| | | | |
|---|---|---|---|
| 1,472,923 | 2/1969 | Germany | 96/1.5 |
| 973,683 | 10/1964 | United Kingdom | 96/1.5 |

*Primary Examiner*—S. Leon Bashore
*Assistant Examiner*—Marc L. Caroff

[57] ABSTRACT

A plurality of abrasion resistant particles are embedded in the layer of photoconductive material on the conductive substrate of a conventional electrostatographic photoreceptor so that generally hemispherical portions of the particles protrude to a height of from 0.5 to 5 microns above the surface of the photoreceptor. The improved photoreceptor is readily adaptable to cleaning by applying a flexible doctor blade to its surface and providing relative motion therebetween.

13 Claims, No Drawings

METHOD OF REDUCING FRICTION IN BLADE CLEANING OF IMAGING SURFACES

This is a division of application Ser. No. 538,041, filed Jan. 2, 1975, now U.S. Pat. No. 3,954,466.

BACKGROUND OF THE INVENTION

The present invention relates to electrostatographic copying and more specifically to an improved xerographic photoreceptor. The art of xerography, as originally disclosed by Carlson in U.S. Pat. No. 2,297,691, involves the uniform electrostatic charging of a plate comprised of a conductive substrate having a layer of a photoconductive material on its surface. This plate is normally referred to as the photoreceptor. Exposing the charged photoreceptor to a pattern of light and shadow dissipates the charge in the light struck areas leaving a latent electrostatic image corresponding to the shadow areas. The latent image is developed by contacting it with a particulate electroscopic marking material known as toner which adheres to the latent image and can be readily transferred to paper in imagewise configuration corresponding to the latent image. Since not all of the toner particles attracted to the latent image are transferred to the paper, a cleaning step is required to remove residual toner before the photoreceptor can be put through another cycle. This can be accomplished by the use of a rotating brush as the cleaning means. An alternative method involves the application of a flexible doctor blade to the photoreceptor, and providing relative motion between the blade and the plate. Experience with this method of cleaning toner has shown that the doctor blade is a simple, efficient and economical method of removing the residual toner from the photoreceptor surface and that the power requirements for this method are extremely low. The doctor blade method of cleaning the photoreceptor surface is more fully described in U.S. Pat. Nos. 3,438,706 to H. Tanaka et al.; 3,552,850 to S. F. Royka et al.; 3,634,977 to W. A. Sullivan; and 3,724,020 to Henry R. Till. While the blade method of cleaning has definite advantages over other cleaning methods, it has proven problematical in some instances due to friction between the photoreceptor surface and the blade causing the blade to chatter and occasionally fold over during the cleaning operation.

It is an object of the present invention to provide a novel electrostatographic photoreceptor suitable for cleaning with a thin edged doctor blade.

An additional object is to provide such a photoreceptor in which the friction between the doctor blade and photoreceptor surface is less than that observed with conventional photoreceptors.

A further object is to provide such a photoreceptor which when cleaned with a doctor blade is less subject to blade chattering and fold over than are conventional photoreceptors.

A further object is to provide such a photoreceptor which when cleaned with a doctor blade is less subject to abrasion than conventional photoreceptors.

SUMMARY OF THE INVENTION

The present invention is an improvement to a conventional electrostatic photoreceptor comprised of a conductive substrate having on its surface, and in operative contact therewith, a layer of photoconductive material. The improved photoreceptor, which is suitable for cleaning by the application of a thin edged doctor blade to its surface while maintaining relative motion therebetween, contains a plurality of abrasion resistant particles embedded in the layer of photoconductive material so that generally hemispherical portions of the particles protrude above its surface. The protruding portions are further defined in that they protrude to a distance of from about 0.5 to about 5 microns above the surface of the photoreceptor and are distributed so that less than 50 percent of the photoreceptor surface is covered by them. The minimum distance between particles is about 2 diameters of the protruding hemispherical portion with the maximum average distance being no greater than the contact width of the doctor blade.

DETAILED DESCRIPTION

The purpose of the present invention is to provide a method which can be used to reduce abrasion and improve the frictional characteristics of an electrostatographic photoreceptor surface (either organic or inorganic) by partial entrapment of small, abrasion resistant particles in the photoreceptor surface. The particles are of a shape and size sufficient to provide a protruding portion which is generally hemispherical in shape and which protrudes to a height of from about 0.5 to 5 microns above the photoreceptor surface. When this type of photoreceptor is cleaned with a doctor blade as previously described, the protruding hemispherical portions of the partially embedded particles reduce the intimate contact between the doctor blade and the photoreceptor surface thus reducing abrasion and friction because the blade rides on the protrusions.

It is not necessary that the particles embedded in the photoconductive layer be of a lubricating material. Thus, a material exhibiting a high coefficient of friction with the doctor blade can be used since the reduced contact area between the blade and the photoreceptor of the present invention will reduce the overall friction between the blade and the photoreceptor. Materials exhibiting a low coefficient of friction with the doctor blade are, of course, preferred for use as the protruding particles.

The shape of the particles is not critical provided that they have a configuration which provides a protruding portion which is generally hemispherical in configuration. Thus, ellipsoidal or parabolic particles can be used with spherical shaped particles being preferred. The particles are dispersed in the photoconductive layer to provide a surface having lands and valleys with the protruding portions of the particles representing the lands and the exposed photoconductive material representing the valleys. Generally, the lands will cover less than about 50% of the total photoreceptor area with an area of particle coverage no greater than about 30% being preferred. The maximum distance between the periphery of each land should be no greater than the blade contact width. Thus, if the photoreceptor is intended for cleaning with a doctor blade having a 20 $\mu$ contact width, the average distance between the periphery of each land would be no greater than 20 $\mu$.

If a doctor blade having a 10 $\mu$ contact width were to be used, particles having hemispherical protruding portions of less than 5 $\mu$ would necessarily be employed. This is the case because a hemispherical protruding portion extending 5 $\mu$ above the photoreceptor would have an apparent diameter of 10 $\mu$ so that positioning the particles in a configuration such that the space between protruding portions is 10 $\mu$ (the contact width of the blade) would result in violating the requirement that the distance between protrusions be no less than 2 diameters of the hemispherical portion. It is not necessary that the centers of the protruding portions be at a distance no greater than the contact width of the blade. Even spacing of the particles so that the average distance between their peripheries is no greater than the contact width of the blade is sufficient since this configuration will insure blade contact with a sufficient number of particles to accomplish the objects of the invention. As previously mentioned, the minimum distance between the lands should be no less than about two diameters of the hemispherical protruding portions. Selection of optimum particle protrusion distance and particle spacing for a given doctor blade will depend on the contact width of the blade and can readily be determined by calculation.

Another consideration which must be kept in mind when determining how high above the surface of the photoconductive layer of the photoreceptor the hemispherical portions of the embedded particles should protrude is the size and size distribution of the toner particles to be used in developing the latent image. Since the toner particles must be accessible to the doctor blade during the cleaning step, the depth of the valleys on the photoreceptor surface should be no greater than about one-half the diameter of the toner particles. Thus, when preparing a photoreceptor intended for use with toner particles having a diameter of 8 $\mu$, the protrusions would extend no more than 4 $\mu$ above the photoreceptor surface. Typically, commercial toner formulations contain a rather wide distribution of particle size, so that a particular formulation having a mean diameter of 20 $\mu$ would contain a substantial number of toner particles of diameters less than 20 $\mu$ and a few as small as 1 or 2 $\mu$ in diameter. In this situation, the depth of the valleys would normally be less than the maximum of 5 $\mu$ in order to avoid trapping of the smaller particles. Protrusions on the order of 0.5 $\mu$ would ensure contact between the cleaning blade and even the smallest toner particles. As a practical matter, deeper valleys on the order of 1 to 2 $\mu$ can be tolerated since the amount of very small particles will normally be low enough so as not to result in undue toner buildup between regular machine servicing periods.

Suitable materials from which the particles can be fabricated include those compositions which are sufficiently abrasion resistant to resist the abrasion encountered during the cleaning step of the copying cycle and can be obtained or fabricated in a configuration having at least one generally hemispherical side. One class of materials which is suitable is made up of synthetic organic resins such as (in their descending order of abrasion resistance) polyurethane, polyamides, polyethylene, polypropylene, polycarbonates, PMMA-acrylonitrile, PMMA and polystyrene. Abrasion resistant inorganic materials such as, for example, silica, glass and inorganic ceramics can be used. Typically, the material selected for fabrication of the particle will have a resistivity which places it either in the insulator or semiconductor category.

Several methods can be used to fabricate the novel photoreceptor of the instant invention. One method of embedding microspheres in an inorganic photoconductor such as selenium involves attaching the spherical particles to a substrate such as aluminum and then vapor depositing selenium onto the substrate to a depth sufficient to cover at least half of the spherical particles and leave protrusions extending above the deposited selenium to the desired height. Pretreatment of the spheres prevents the formation of a selenium layer on their surfaces. In another embodiment, the embedded particles extend only part way through the layer of photoconductive material. This is accomplished by depositing part of the layer of photoconductive material on the substrate before applying the particles. Typically, the lower surface of the particle will be separated from the conductive substrate by a distance of at least one-half of the total thickness of the photoconductive layer. This embodiment is preferred since it will prevent the formation of strong local electrostatic fields in the area around the protruding portions by allowing light to leak around the particle to discharge the photoconductive material under it and thereby reduce the local fields.

Application of the particles to the substrate or partial photoconductive layer on the substrate's surface can be accomplished in one of several ways. For example, the particles can be charged and attracted to the substrate from their supporting member by applying to the substrate a charge of opposite polarity. In the case of an organic photoconductor such as one comprising 2,4,7-trinitro-9-fluorenone in poly(vinylcarbazole) or an inorganic photoreceptor overcoated with either an active transport or insulating resin, the polymeric material can be heated to its softening point and the particles applied to the tackified layer and embedded therein. Alternatively, the particles can be mixed with the organic material and a solvent therefore and the mixture applied to the conductive substrate with a doctor blade to form a monolayer of the particles in the photoconductive layer. As the solvent evaporates, the polymeric material will shrink to leave portions of the particles protruding from its surface.

A fabrication method which tends to provide better control over placement of the particles involves formation of a monolayer of the particles in a Langmiur balance. After formation of the monolayer of particles, a prepolymer is applied and polymerized in situ, such as by the use of U.V. light, to provide a polymeric film having the particles protruding from its surface which can be affixed to the substrate by use of a suitable adhesive, e.g. a conductive epoxy. An alternative method for achieving even distribution for the particles is to apply them through a grid laid over the substrate or tackified polymeric layer as the case may be.

As will be recognized by those skilled in the art, in order to provide an operable photoreceptor, it is necessary that there be a blocking layer between the conductive substrate and the photoconductor to prevent charge injection from the substrate during the charging step. Where the substrate surface is naturally blocking as in the situation where substantial amounts of energy are required to promote charge carriers from the substrate into the photoreceptor body, no additional blocking material is required. Where a distinct blocking layer is required, a separate layer is applied to the substrate. Typical blocking materials may be employed in thicknesses from about 30 A to 1.0 micron and include nylon, epoxies, aluminum oxide (as in the case of an aluminum substrate whose surface has been oxidized) and insulating resins of various types including polystyrenes, butadiene polymers and copolymers, acrylic and methacrylic polymers, vinyl resins, alkyd resins and cellulose base resins.

In operation, the photoreceptor is charged, imaged, developed with toner and the toner image transferred to a receiving member such as paper in the ordinary xerographic mode. The cleaning step is carried out by applying a thin edged doctor blade to the imaging surface under sufficient pressure to cause the residual toner to be pushed along in front of the blade when relative motion is applied between the blade and the photoreceptor. This motion is ordinarily applied by holding the doctor blade motionless and revolving the photoreceptor drum. The leading edge of the doctor blade is preferably positioned to form an acute angle of less than about 90° and greater than about 20° with the plane tangent to the imaging surface at the line of blade contact. In this configuration, the residual toner particles are removed by a scraping rather than a chiseling action of the cleaning blade.

The cleaning blade is normally made of a non-metallic, flexible material such as for example, polysiloxanes, polyurethanes, polytetrafluoroethylenes, styrene/-butadiene resins, nitrile/silicone rubbers, polyethylenes or blends, mixtures and copolymers thereof. The protruding hemispherical portions of the embedded particles will reduce abrasion of the photoreceptor surface as previously described. However, it is still preferred that the blade be of a sufficiently soft material, such as those exemplified, to minimize abrasion of the protruding portions of the particles.

The method of practicing the invention is further illustrated by the following examples.

EXAMPLE I

Glass beads, generally spherical in shape and having diameters of approximately 20 $\mu$ are combined with a teflon oligomer sold under the tradename Vydex and thoroughly agitated to provide a uniform layer of the oligomer on the bead surfaces. The coated particles are distributed on an aluminum substrate and the assembly placed in a vacuum coater. At this point, amorphous selenium is evaporated onto the substrate to a depth of approximately 16 $\mu$. The selenium does not adhere to the glass beads due to their coating, so that the foregoing procedure provides a photoreceptor of an aluminum substrate having on its surface a 16 $\mu$ thick layer of amorphous selenium with hemispherical protrusions extending at a maximum of about 4 microns above the selenium layer. The protrusions are spaced such that their peripheries are at an average distance of about 20 $\mu$ to provide a photoreceptor with about 33% of its surface covered by non-conductive particles.

The photoreceptor is charged, exposed in image configuration and developed with toner having a mean particle diameter of 20 $\mu$.

The toner image is transferred to a receiving member in the normal xerographic mode and the photoreceptor cleaned of residual toner by subjecting it to a corotron of opposite polarity as that used for the original charging step and applying a flexible polyurethane doctor blade having a contact width of 20 $\mu$ to the photoreceptor while providing relative motion between the doctor blade and photoreceptor.

The blade effectively removes residual toner from the photoreceptor surface without chatter or foldover.

EXAMPLE II

A photoreceptor according to the present invention is prepared as in Example I except that before application of the glass beads, a layer of amorphous selenium 20 $\mu$ thick is deposited on the aluminum substrate. The coated beads are placed on the substrate as before and a second 18 $\mu$ thick layer of selenium is vapor deposited to provide a photoreceptor having protrusions 2 $\mu$ above the surface of the photoconductor with an average distance between protrusions of about 9 $\mu$.

The photoreceptor is charged, exposed, developed and the toner image transferred as before. Cleaning is carried out as in Example I except that a doctor blade having a 10 $\mu$ contact width is used. Cleaning is accomplished without chatter or foldover.

We claim:

1. A method of cleaning an electrostatographic photoreceptor comprised of a conductive substrate having a layer on its surface of a photoconductive material in operative connection with the substrate, wherein said photoreceptor contains a plurality of abrasion resistant particles partially embedded in the layer of photoconductive material so that generally hemispherical portions of the particles protrude above the surface of said layer, said protruding portions being further defined in that they protrude to a distance of about 0.5 to 5 microns above the layer of photoconductive material and are distributed so that less than 50 percent of the photoreceptor surface is covered by the protruding portions, said cleaning method comprising the steps of:

a. applying a thin edged doctor blade having a contact width equal to or greater than the maximum average distance between the peripheries of the protruding portions of the abrasion resistant particles, and b. maintaining relative motion between the photoreceptor surface and the doctor blade.

2. The method of claim 1 wherein the embedded particles are ellipsoidal or parabolic in shape.

3. The method of claim 1 wherein the embedded particles are spherical in shape.

4. The method of claim 1 wherein the protruding portions of the embedded particles cover no greater than about 30% of the photoreceptor surface.

5. The method of claim 1 wherein the embedded particles are made of a synthetic organic resin.

6. The method of claim 5 wherein the synthetic organic resin is a polyurethane, a polyamide, a polyethylene, a polypropylene, a polycarbonate, PMMA-acrylonitrile, PMMA or polystyrene.

7. The method of claim 1 wherein the embedded particles are made of an inorganic material selected from the group of silica or glass.

8. The method of claim 1 wherein the embedded particles are made of an inorganic ceramic.

9. The method of claim 1 wherein the lower surfaces of the embedded particles are separated from the conductive substrate by the photoconductive material.

10. The method of claim 9 wherein the embedded particles are separated from the conductive substrate by a distance of at least one-half of the total thickness of the photoconductive layer.

11. The method of claim 1 wherein the photoconductive material is amorphous selenium.

12. The method of claim 1 wherein the doctor blade is made of a non-metallic flexible material.

13. The method of claim 12 wherein the non-metallic, flexible material is a polysiloxane, a polyurethane, a polytetrafluoroethylene, a styrene/butadiene resin, a nitrile/silicone rubber or a polyethylene.

* * * * *